US005740671A

United States Patent [19]

Jones

[11] Patent Number: 5,740,671

[45] Date of Patent: Apr. 21, 1998

[54] BALANCE BOX EXHAUST ACCELERATOR

[76] Inventor: Mack L. Jones, M.A.C. Products, Inc. 43214 Black Deer Loop, Unit 113, Temecula, Calif. 92590-3473

[21] Appl. No.: 831,021

[22] Filed: Apr. 1, 1997

[51] Int. Cl.[6] ..... F01N 7/10

[52] U.S. Cl. ..... 60/323

[58] Field of Search ..... 60/323; 181/238, 181/239, 240

[56] References Cited

U.S. PATENT DOCUMENTS

| | | | |
|---|---|---|---|
| 4,621,494 | 11/1986 | Fujita | 60/323 |
| 4,953,352 | 9/1990 | Campbell | 60/323 |
| 5,214,253 | 5/1993 | Houston | 181/238 |
| 5,216,883 | 6/1993 | Flugger | 60/323 |

OTHER PUBLICATIONS

Article by a staff reporter of pp. 40–44 in the Mar. 1997 issue of *5.0 Mustang* entitled "MAC Attack," Petersen Publishing Company, L.L.C.

*Primary Examiner*—Marguerite McMahon

*Attorney, Agent, or Firm*—Loyal McKinley Hanson

[57] ABSTRACT

An exhaust component for an internal combustion engine includes a housing having an interior. Left and right inlet tubes are provided on an inlet end wall of the housing for conveying exhaust gases to the interior, and at least one outlet tube is provided on an opposite outlet end wall of the housing for conveying the exhaust gases from the interior. A first panel extending between top and bottom walls of the housing in a position intermediate the inlet and outlet end walls defines an outlet opening in fluid communication with the outlet tube. Second and third panels extend convergingly toward the outlet opening from left and right side walls of the housing in order to direct the exhaust gases toward the outlet opening. One embodiment includes both left and right outlet tubes that extend from the outlet end wall to the outlet opening covergingly so that both the left and right outlet tubes are in fluid communication with the outlet opening. Preferably, the first, second, and third panels are parts of a plate bent into a three-panel configuration. Preferably, the first, second, and third panels cooperate with the top and bottom walls, the left and right side walls, and the outlet end wall to form a Helmholtz chamber, and the left and right inlet tubes are flared.

7 Claims, 3 Drawing Sheets

BALANCE BOX EXHAUST ACCELERATOR

BACKGROUND OF THE INVENTION

1. Technical Field

This invention relates generally to exhaust systems for internal combustion engines, and more particularly to an exhaust component that installs downstream of dual headers for improved flow, sound, and horsepower.

2. Description of Related Art

Car owners replace stock exhaust components with after-market components to improve performance. The automobile manufactured and sold by the Ford Motor Company under the trademark "5.0 MUSTANG" is a favorite candidate for such modification, as are many other commercially available and custom-made cars, and much time and effort is directed to the precise details of each component. Despite the many known stock and after-market exhaust components currently available, however, designers, manufacturers, owners, and users still seek better and more effective ways to improve the flow of exhaust gases, control exhaust noise, and increase horsepower and gas mileage with components that offer the other desirable features of being compact, lightweight, and cost effective.

SUMMARY OF THE INVENTION

This invention addresses the need described above by providing a single chamber downstream of the headers into which exhaust gases from both headers flow, expand, merge, and accelerate before proceeding out a common outlet opening to one or more outlet pipes. A Helmholtz chamber helps control noise. Tests show improved flow, sound, and horsepower.

To paraphrase some of the claim language that is subsequently presented, an exhaust component constructed according to the invention includes a housing having an interior enclosed by opposite top and bottom walls, opposite left and right side walls, and opposite inlet and outlet end walls of the housing. Left and right inlet tubes are provided on the inlet end wall for conveying exhaust gases to the interior of the housing. One or more outlet tubes are provided on the outlet end wall for conveying the exhaust gases from the interior.

Means are provided for defining a common outlet opening intermediate the inlet and outlet end walls that is in fluid communication with the outlet tubes. For that purpose, a first panel is provided in the interior of the housing intermediate the inlet and outlet end walls. The first panel extends vertically between the top and bottom walls of the housing and laterally intermediate the left and right sidewalls. The first panel defines the outlet opening (i.e., it has a hole in it). The outlet tubes extend from the outlet end wall to the outlet opening so that they are in fluid communication with the outlet opening.

Means are also provided for directing the exhaust gases toward the outlet opening. That function is accomplished by second and third panels called an accelerator panels. They also extend vertically between the top and bottom walls of the housing and convergingly from the left and right side walls to left and right sides of the outlet opening.

Preferably, the first, second, and third panels are parts of a plate bent into a three-panel configuration, and they cooperate with the top and bottom walls, the left and right side walls, and the outlet end wall to form a Helmholtz chamber. Preferably, the left and right inlet tubes have inwardly facing end portions that are flared. One embodiment includes a single outlet tube. Another embodiment includes both left and right outlet tubes. The following illustrative drawings and detailed description make the foregoing and other objects, features, and advantages of the invention more apparent.

DESCRIPTION OF THE PREFERRED EMBODIMENTS

Figure 1:
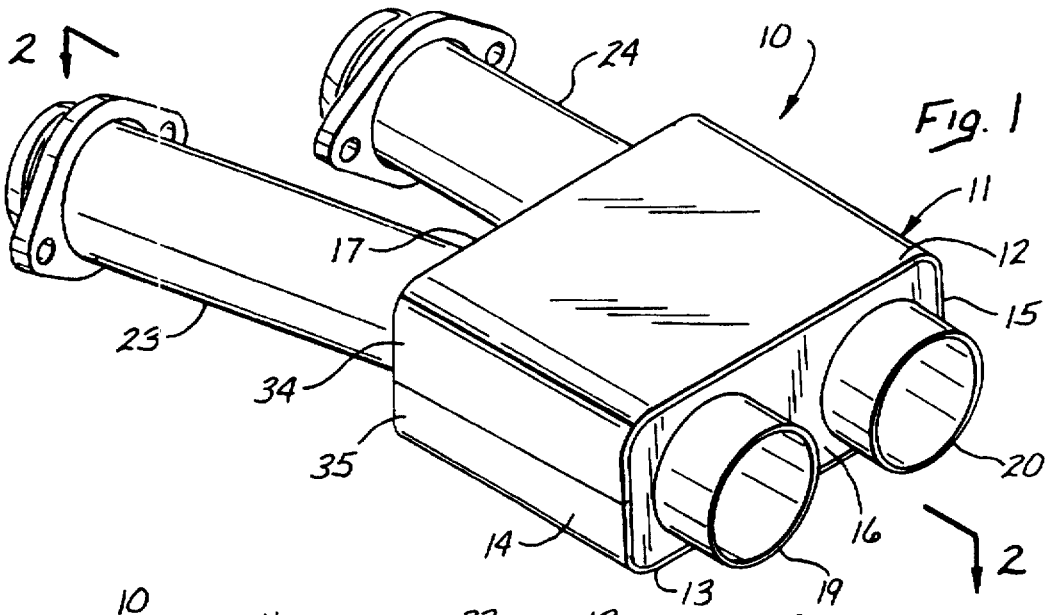
FIG. 1 of the drawings is a perspective view of a balance box exhaust accelerator component constructed according to the invention.
Figure 3:
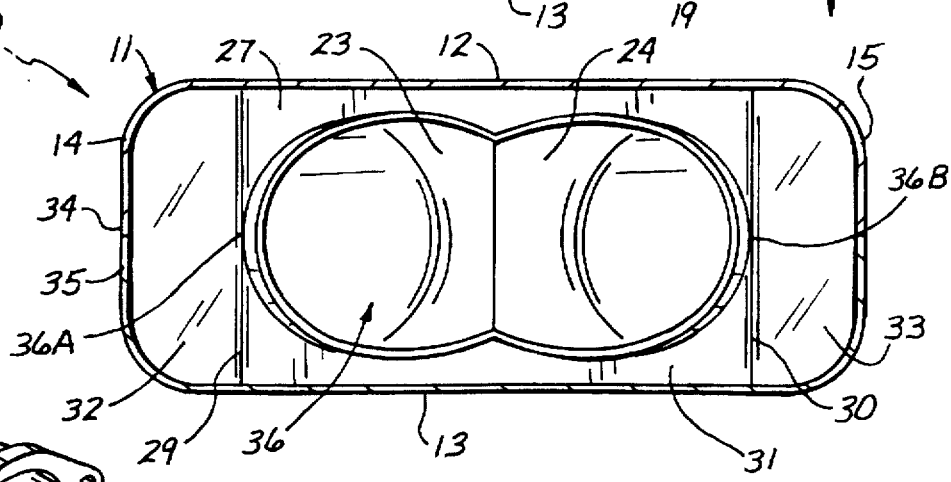
FIG. 3 is a cross sectional view of the exhaust component taken in a vertical plane identified by a line 3—3 in FIG. 2.
Figure 2:
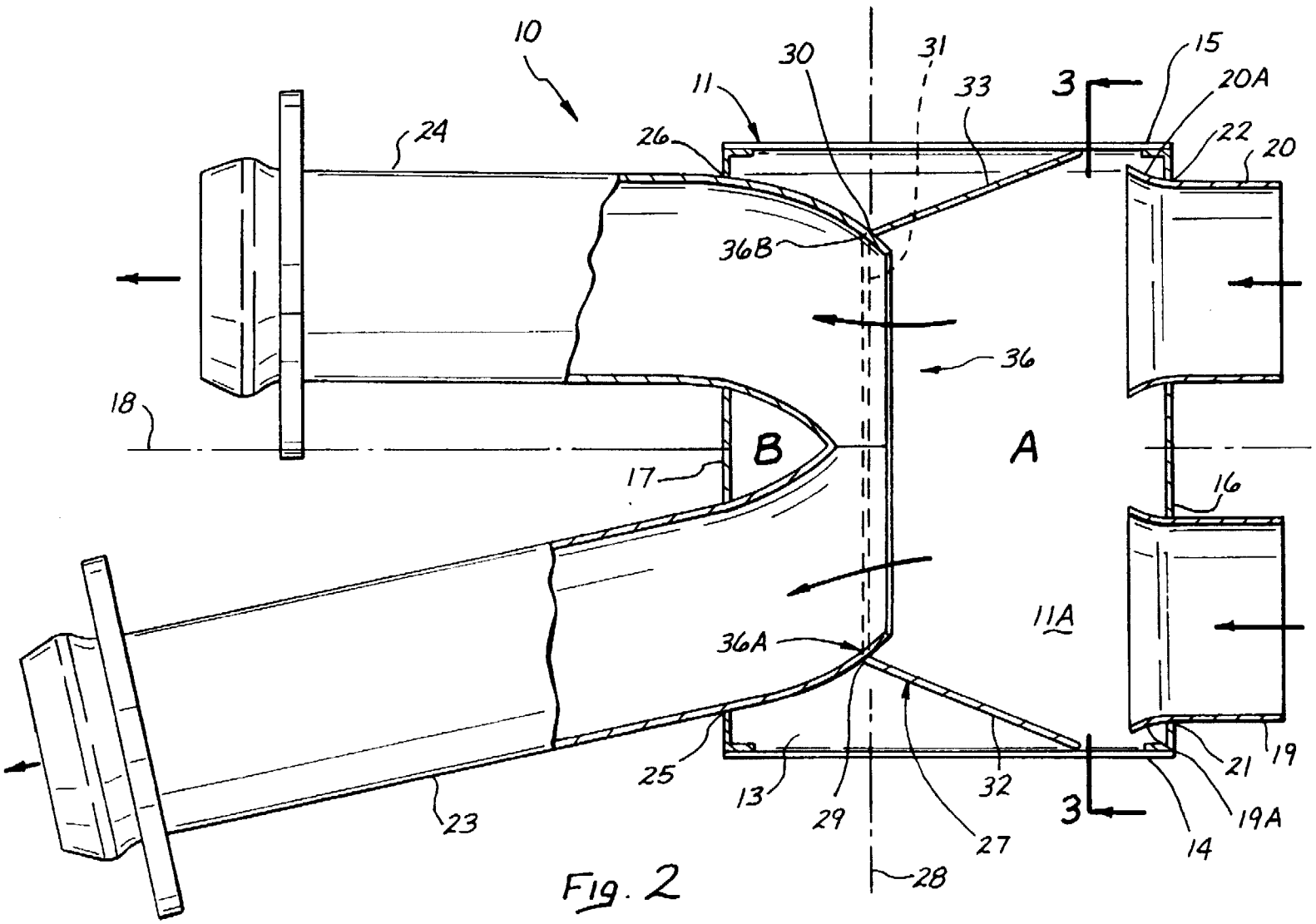
FIG. 2 is a cross sectional view of the exhaust component taken in a horizontal plane identified by a line 2—2 in FIG. 1.

FIGS. 1–3 of the drawings show an exhaust component 10 constructed according to the invention. Generally, it includes a housing 11 (FIGS. 1–3) having an interior 11A (FIG. 2) enclosed by parallel top and bottom walls 12 and 13, parallel left and right side walls 14 and 15, and parallel inlet and outlet end walls 16 and 17 that are welded together with air tight joints. It is referred to subsequently as a balance box 10, and it is described from the viewpoint of an observer facing the inlet end wall 16 toward the outlet end wall 17, along a longitudinal axis 18 (FIG. 2), with the bottom wall 13 disposed horizontally.

First and second inlet tubes, that are referred to from the viewpoint of such an observer as left and right inlet tubes 19 and 20 (FIGS. 1 and 2), extend through first and second inlet openings referred to as left and right inlet openings 21 and 22 in the inlet end wall 16 (FIG. 2). They serve the function of conveying exhaust gases to the interior 11A of the housing 11. First and second outlet tubes, that are referred to from the viewpoint of such an observer as left and right outlet tubes 23 and 24 (FIGS. 1–3), extend through first and second outlet openings referred to as left and right outlet openings 25 and 26 in the outlet end wall 17 (FIG. 2). They serve the function of conveying exhaust gases from the interior 11A of the housing 11. When the balance box 10 is installed, the left and right inlet tubes 19 and 20 are coupled to headers on an internal combustion engine (not shown), and the left and right outlet tubes 23 and 24 are coupled to tailpipes or other downstream exhaust components (not shown). Exhaust gases flow through the balance box 10 as depicted by the arrows in FIG. 2.

A plate 27 (FIGS. 2 and 3) is disposed within the interior 11A of the housing 11. The plate 27 extends vertically (i.e., perpendicular to the bottom wall 13) between the top and bottom walls 12 in a transversely extending plane 28 (FIG. 2) that is also perpendicular to the bottom wall 13. The plate 27 includes a 110-degree first or left side bend 29 and a 110-degree second or right side bend 30 that serve to form a first or mid panel 31, a second or left side panel 32, and a third or right side panel 33 FIGS. 2 and 3). Of course, the panels 31–33 can be otherwise suitably fabricated (e.g., by welding three panels together to form the plate 27).

The plate 27 is welded, bolted, or otherwise suitably mounted in the illustrated position within the interior 11A of the housing 11. There, it separates the interior 11A into a upstream or rearward region A of the interior 11A and a downstream or forward region B of the interior 11A. The rearward region A extends vertically between the top and bottom walls 12 and 13, laterally between the left and right side walls 14 and 15, and longitudinally along the longitudinal axis 18 between the inlet end wall 16 and the plate 27. The forward region B extends vertically between the top and bottom walls 12 and 13, laterally between the left and right side walls 14 and 15, and longitudinally along the longitudinal axis 18 between the plate 27 and the outlet end wall 17.

To aid fabrication, the housing 11 may include a top portion 34 (FIGS. 1 and 3) and a bottom portion 35 (FIGS. 1–3) that are welded together in a known way to form the housing 11. The top portion is a U-shaped component that forms the top wall 12 and upper portions of the left and right side walls 15 and 16. The bottom portion 35 is also a U-shaped component. It forms the bottom wall 13 and lower portions of the left and right side walls 15 and 16.

The inlet and outlet end walls 16 and 17 are welded to the bottom portion 35. The plate 27 is also welded to the bottom portion 35, and then the top portion 34 is added. The top portion 34 may have holes in it (not shown) that enable the manufacturer to weld the plate 27 to the top portion 35 after first welding the top portion 34 to the bottom portion 35. The inlet tubes 19 and 20 are welded with air tight joints to the inlet wall 16, and the outlet tubes 23 and 24 are welded with air tight joints to the outlet wall 17. Of course, those precise details of construction may vary, and variations are well within the abilities of one of ordinary skill in the art.

As a further idea of size, the housing 11 of the illustrated balance box 10 measures about 9.5 inches wide (along the plane 28 in FIG. 2), about 6.5 inches (along the axis 18), and about 3.75 inches high (between the top and bottom walls 12 and 13). The inlet and outlet tubes are about 2.5 inches in diameter, with the outlet opening 36 measuring about 5.5 inches wide as a result. Of course, those measurements may vary a good deal according to the precise application without departing from the inventive concepts disclosed. The illustrated balance box 10 is designed for use with a 300 cubic inch V-8 engine on a 5.0 MUSTANG automobile, and it is constructed of 1.2-mm thick AK metal (steel with 8 percent aluminum) that is given a high-temperature coating (HTS).

With further regard to the plate 27, the mid panel 31 defines an outlet opening 36 (FIGS. 2 and 3). It functions as means for defining a common outlet opening intermediate the inlet and outlet end walls 16 and 17 that is in fluid communication with the outlet tubes 23 and 24. The outlet opening 36 extends through the mid panel 31, and it functions as a single common outlet opening through which the exhaust gases must flow in passing from the rearward region A of the interior 11A into the left and right outlet tubes 23 and 24. The left and right outlet tubes 23 and 24 extend from the outlet end wall 17 to the outlet opening 36 where they are welded together and to the mid panel 31 with an air tight joint.

The left side panel 31 extends vertically between the top and bottom walls 12 and 13, and horizontally from the left side wall 14 to a left side 36A of the outlet opening 36 (FIGS. 2 and 3). The bend 29 is located adjacent the left side 36A. Similarly, the right side panel 33 extends vertically between the top and bottom walls 12 and 13, and horizontally from the right side wall 15 to a right side 36B of the outlet opening 36. The bend 30 is located adjacent the right side 36B. In other words, the left and right side panels 32 and 33 extend convergingly from the left and right side walls 14 and 15 to the left and right sides 36A and 36B of the outlet opening 36. So disposed, the left and right side panels 32 and 33 function as means for directing the exhaust gases toward the outlet opening 36. In doing so, they also cause the exhaust gases to accelerate toward the outlet opening 36.

Exhaust gases entering the interior 11A through the inlet tubes 19 and 20, expand and merge in the rearward region A. Next, they accelerate as they are directed by the panels 32 and 33 toward the outlet opening 36. Then, they pass through the outlet opening 36 into the outlet tubes 23 and 24 where they split into two streams directed toward whatever downstream components are connected to the outlet tubes.

As the foregoing occurs, the forward region B of the interior 11A functions as a Helmholtz chamber providing noise control, a Helmholtz chamber that is not directly coupled to the rearward region A. Thus, the panels 31—33 are parts of a plate bent into a three-panel configuration, and they cooperate with the top and bottom walls 12 and 13, the left and right side walls 14 and 15, and the outlet end wall 17 to form the Helmholtz chamber (the region B). Of course, one of ordinary skill in the art can, without departing from the scope of the claims, provide suitable openings in the plate 27 to directly couple the Helmholtz chamber to the rearward region A. Preferably, the left and right inlet tubes 19 and 20 have inwardly facing end portions 19A and 20A that are flared to enhance the flow of exhaust gases into the interior 11A.

Thus, the invention provides a single chamber downstream of the headers into which exhaust gases from both headers flow, expand, merge, and accelerate before proceeding out a common outlet opening to one or more outlet pipes. Comparative testing on a 300 cubic inch engine shows that the balance box 10 provides desirable sound and flow as well as an increase of approximately 23 horsepower.

Figure 4:
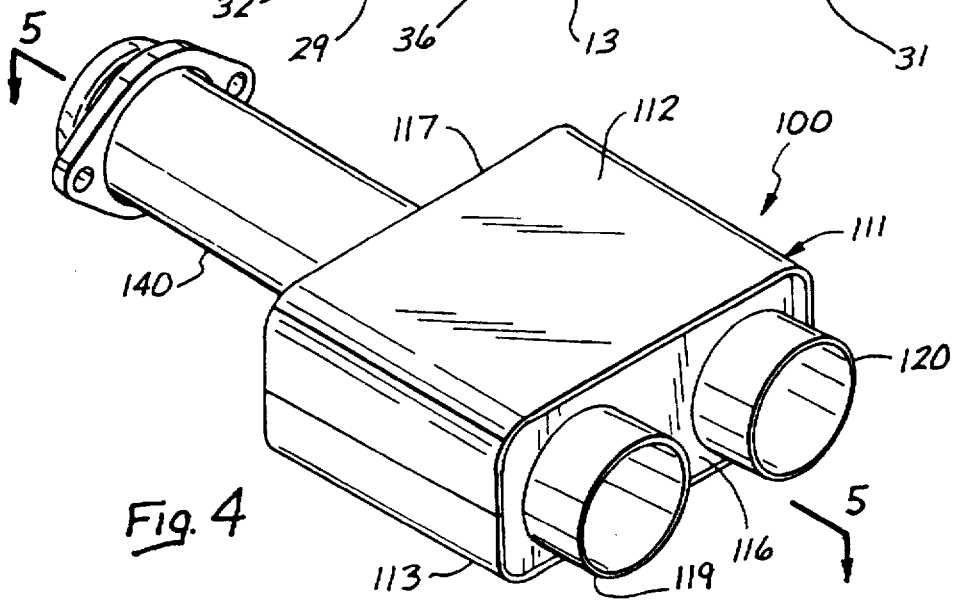
FIG. 4 is perspective view of a second embodiment having just one outlet tube.
Figure 5:
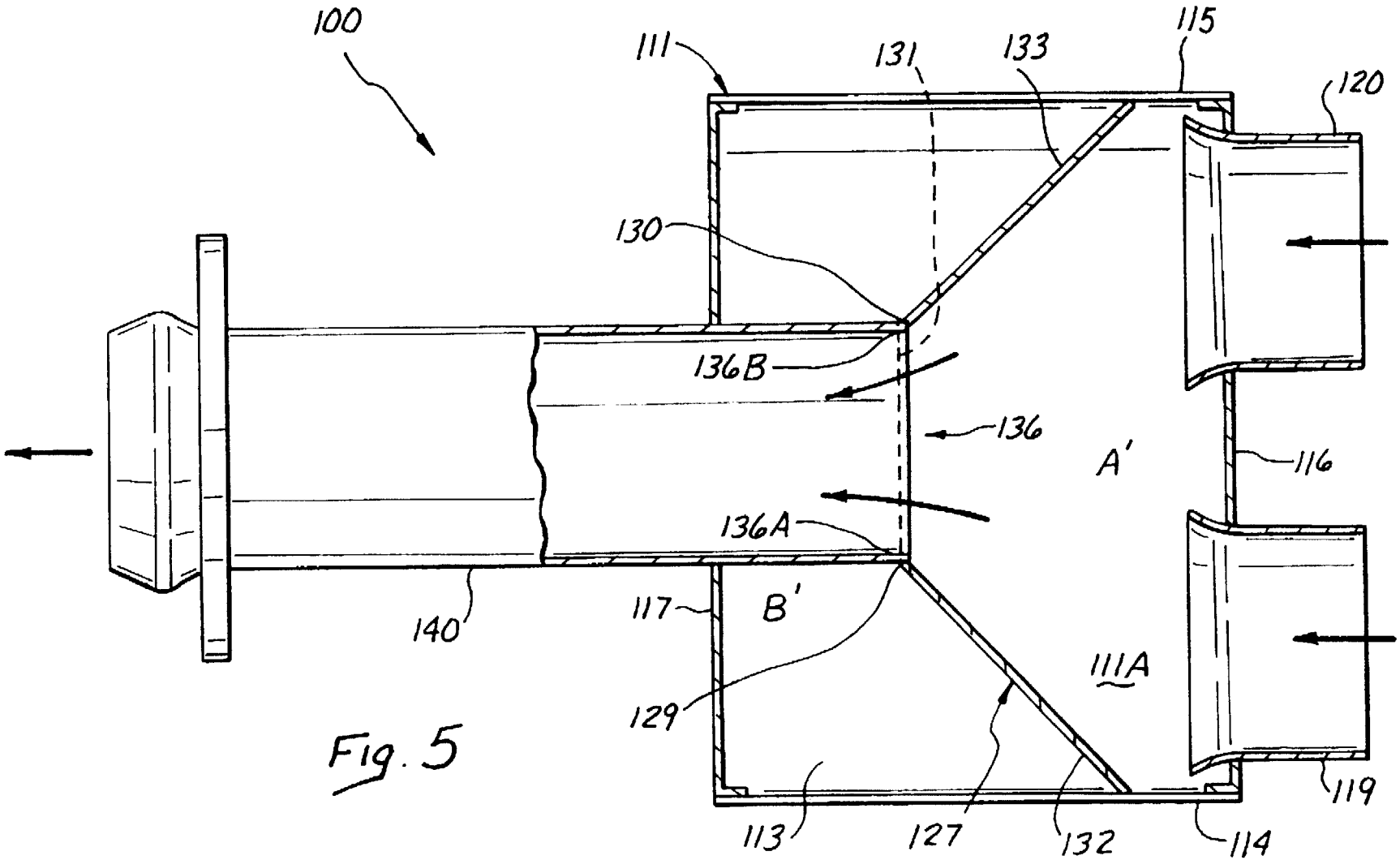
FIG. 5 is a cross sectional view of the second embodiment taken in a horizontal plane identified by a line 5—5 in FIG. 4.

FIGS. 4 and 5 show another balance box 100 constructed according to the invention that includes a single outlet tube 140. The balance box 100 is similar in many respects to the balance box 10, and so only differences are described in further detail. For convenience, reference numerals designating parts of the balance box 100 illustrated in FIGS. 4 and 5 are increased by one hundred over those designation corresponding parts of the balance box 10 illustrated in FIGS. 1–3.

Like the balance box 10, the balance box 100 includes a housing 111 having an interior 111A (FIG. 5) enclosed by parallel top and bottom walls 112 and 113, parallel left and right side walls 114 and 115, and parallel inlet and outlet end walls 116 and 117. First and second inlet tubes 119 and 120 are welded to the inlet end wall 116, while just the one outlet tube 140 is welded to the outlet end wall 117 (FIGS. 4 and 5).

A plate 127 within the housing 11 separates the interior 111A into a rearward region A' where exhaust gases expand and merge, and a forward region B' that forms a Helmholtz chamber. The plate 127 includes bends 129 and 130 that form the plate 127 into a three-panel configuration having a mid panel 131 that defines an common outlet opening 136, a left side panel 132 extending from the left side wall 114 to a left side 136A of the outlet opening 136, and a right side panel 133 extending from the right side wall 115 to a right side 136B of the outlet opening 136.

Exhaust gases entering the interior 111A through the inlet tubes 119 and 120, expand and merge in the rearward region A'. Next, they accelerate as they are directed by the panels 132 and 133 toward the outlet opening 136. Then, they pass through the outlet opening 136 into the single outlet tube 140 toward whatever downstream component is connected to the outlet tube. As the foregoing occurs, the forward region B' of the interior 111A functions as a Helmholtz chamber providing noise control.

Thus, the balance box 100 also provides a single chamber downstream of the headers into which exhaust gases from both headers flow, expand, merge, and accelerate before proceeding out a common outlet opening to the outlet pipe for improved flow, sound, and horsepower. Although exemplary embodiments have been shown and described, one of ordinary skill in the art may make many changes, modifications, and substitutions without necessarily departing from the spirit and scope of the invention.

What is claimed is:

1. An exhaust component, comprising:

a housing having an interior, the housing including opposite top and bottom walls, opposite left and right side walls, and opposite inlet and outlet end walls that enclose the interior;

means for conveying exhaust gases to the interior of the housing, including left and right inlet tubes on the inlet end wall;

means for conveying the exhaust gases from the interior, including at least one outlet tube on the outlet end wall;

means for defining an outlet opening intermediate the inlet and outlet end walls that is in fluid communication with the outlet tube, said means including a first panel that extends between the top and bottom walls of the housing in a position intermediate the inlet and outlet end walls, the first panel defining the outlet opening and the outlet tube extending from the outlet end wall to the outlet opening so that the outlet tube is in fluid communication with the outlet opening; and means for directing exhaust gases in the interior toward the outlet opening, including second and third panels that extend between the top and bottom walls, the second panel extending from the left side wall to a left side of the outlet opening and the third panel extending from the right side wall to a right side of the outlet opening.

2. An exhaust component as recited in claim 1, wherein the first, second, and third panels are parts of a plate that extends between the top and bottom walls, the plate include first and second bends that define the first, second, and third panels.

3. An exhaust component as recited in claim 1, wherein the first, second, and third panels cooperate with the top and bottom walls, the left and right side walls, and the outlet end wall to form a Helmholtz chamber.

4. An exhaust component as recited in claim 1, wherein the exhaust component includes both a left outlet tube and a right outlet tube on the outlet end wall, the left and right outlet tubes extending from the outlet end wall to the outlet opening convergingly so that both the left and right outlet tubes are in fluid communication with the outlet opening.

5. An exhaust component as recited in claim 1 wherein the left and right inlet tubes have an inwardly facing end portions that are flared.

6. An exhaust component, comprising:

a housing having an interior, the housing including opposite top and bottom walls, opposite left and right side walls, and opposite inlet and outlet end walls that enclose the interior;

means for conveying exhaust gases to the interior of the housing, including left and right inlet tubes on the inlet end wall;

means for conveying the exhaust gases from the interior, including left and right outlet tubes on the outlet end wall;

means for defining an outlet opening intermediate the inlet and outlet end walls that is in fluid communication with the left and right outlet tubes, said means including a first panel extending between the top and bottom walls of the housing in a position intermediate the inlet and outlet end walls, the first panel defining the outlet opening and the left and right outlet tubes extending from the outlet end wall to the outlet opening convergingly so that the left and right outlet tubes are both in fluid communication with the outlet opening; and means for directing exhaust gases in the interior toward the outlet opening, including second and third panels that extend between the top and bottom walls, the second panel extending from the left side wall to a left side of the outlet opening and the third panel extending from the right side wall to a right side of the outlet opening;

wherein the first, second, and third panels cooperate with the housing to form a Helmholtz chamber, and the left and right inlet tubes have inwardly facing end portions that are flared.

7. An exhaust component, comprising:

a housing having an interior, the housing including opposite top and bottom walls, opposite left and right side walls, and opposite inlet and outlet end walls that enclose the interior;

means for conveying exhaust gases to the interior of the housing, including left and right inlet tubes on the inlet end wall;

means for conveying the exhaust gases from the interior, including an outlet tube on the outlet end wall;

means for defining an outlet opening intermediate the inlet and outlet end walls that is in fluid communication with the outlet tube, said means including a first panel extending between the top and bottom walls of the housing in a position intermediate the inlet and outlet end walls, the first panel defining the outlet opening and the outlet tube extending from the outlet end wall to the outlet opening so that the outlet tube is in fluid communication with the outlet opening; and means for directing exhaust gases in the interior toward the outlet opening, including second and third panels that extend between the top and bottom walls, the second panel extending from the left side wall to a left side of the outlet opening and the third panel extending from the right side wall to a right side of the outlet opening;

wherein the first, second, and third panels cooperate with the housing to form a Helmholtz chamber, and the left and right inlet tubes have inwardly facing end portions that are flared.

* * * * *